US009089175B2

(12) United States Patent
Lambertz

(10) Patent No.: US 9,089,175 B2
(45) Date of Patent: Jul. 28, 2015

(54) ARTICLE OF CLOTHING

(75) Inventor: Bodo W. Lambertz, Wilen b Wollerau (CH)

(73) Assignee: X-Technology Swiss GmbH, Wollerau (CH)

( * ) Notice: Subject to any disclaimer, the term of this patent is extended or adjusted under 35 U.S.C. 154(b) by 367 days.

(21) Appl. No.: 13/638,862

(22) PCT Filed: Nov. 14, 2011

(86) PCT No.: PCT/EP2011/069995

§ 371 (c)(1),
(2), (4) Date: Oct. 1, 2012

(87) PCT Pub. No.: WO2012/065929

PCT Pub. Date: May 24, 2012

(65) Prior Publication Data

US 2013/0019377 A1 Jan. 24, 2013

(30) Foreign Application Priority Data

Nov. 15, 2010 (DE) ..... 20 2010 015 339 U

(51) Int. Cl.

| | |
|---|---|
| ***A41D 1/06*** | (2006.01) |
| ***A41D 13/002*** | (2006.01) |
| ***A41D 13/00*** | (2006.01) |
| ***A41D 27/28*** | (2006.01) |

(52) U.S. Cl.

CPC ..... *A41D 13/002* (2013.01); *A41D 13/0015* (2013.01); *A41D 27/28* (2013.01); *A41B 2400/60* (2013.01); *A41D 1/06* (2013.01)

(58) Field of Classification Search

CPC ..... A41D 3/08; A41D 3/04; A41D 19/00; A41D 19/0079; A41D 1/06

USPC ..... 2/79, 272, 227, 159, DIG. 1, DIG. 3, 2/DIG. 5

See application file for complete search history.

(56) References Cited

U.S. PATENT DOCUMENTS

| | | | | |
|---|---|---|---|---|
| 5,438,707 | A * | 8/1995 | Horn | 2/457 |
| 2004/0060095 | A1* | 4/2004 | Bradbury | 2/159 |
| 2005/0086721 | A1* | 4/2005 | Lambertz | 2/69 |
| 2011/0265242 | A1* | 11/2011 | Lambertz | 2/69 |

* cited by examiner

*Primary Examiner* — Danny Worrell
*Assistant Examiner* — Khaled Annis
(74) *Attorney, Agent, or Firm* — Olson & Cepuritis, Ltd.

(57) ABSTRACT

The invention relates to an article of clothing having regions composed of weatherproof fabric, such as water-tight fabric or wind-tight fabric, that contain a climate membrane located on a side of the fabric that faces the skin of a wearer of the article of clothing. The membrane comprises a plurality of small tubes with two open ends between a peripheral surface. The peripheral surface of the small tubes further includes openings configured to aid in the removal of sweat of the wearer.

18 Claims, 5 Drawing Sheets

ARTICLE OF CLOTHING

RELATED APPLICATION

Figure 1:
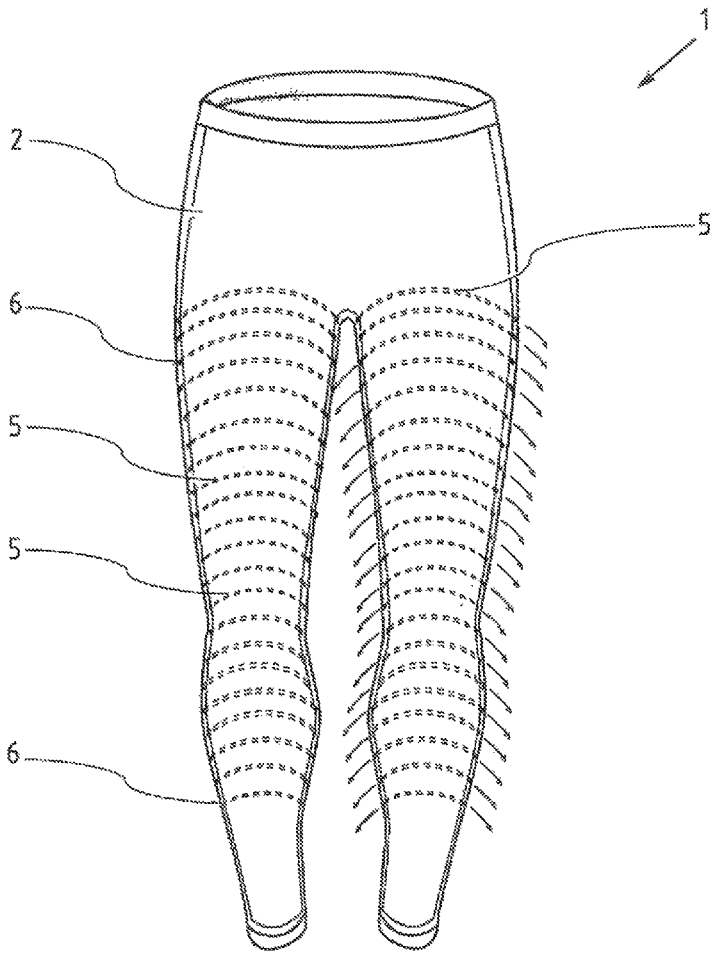

This is a national stage filing of International Application Serial No. PCT/EP2011/069995 filed Nov. 14, 2011.

The invention relates to an article of clothing, particularly for wearing directly on the skin, which consists, at least in certain areas, of a water-tight and/or wind-tight fabric that contains a weatherproofing membrane.

Clothing essentially has the task of protecting the body against external influences. The external influences consist, first of all, of weather conditions—that is to say, the influence of wind, moisture, and cold on the body. In addition, clothing has the task of providing the specific user with a comfortable wearing sensation. A good dissipation of the heat energy produced by the body, or even sweat produced by the body at higher external temperatures, is thereby important, particularly in sports activities.

It is known to use weatherproofing membranes to achieve good protection against weather conditions. This thereby creates the possibility of blocking the wind or water acting on the body from the outside, but also of providing a permeability for vapor to move from the interior to the exterior in order to make a dissipation of the heat energy, as well as of the sweat produced by the body, possible. The membranes known under the trade names "Gore-Tex®" or "Sympatex®" should thereby be noted as the best known.

The use of weatherproofing membranes does, to be sure, essentially offer the possibility of dissipating heat produced by the body to the outside. Because of the technical requirements for the membrane, however, this is only possible to a limited extent. The known membranes are only able to completely dissipate the water droplets and the water vapor given off by the body through the pores of the membrane and to the outside to a very limited extent, particularly during physical activities that are unusually strenuous, such as running or bicycling, for example. During a major accumulation of moisture during severe sweating, it frequently happens that the moisture condenses on the side of the membrane oriented towards the skin of the wearer, which moisture then collects into large drops of sweat and thereby soaks the adjoining fabric layers as well as articles of clothing that are worn underneath the same.

The task that forms the basis for the invention is that of creating an article of clothing that is able to bring about a sufficient dissipation of the moisture through the article of clothing to the outside, even during unusually vigorous physical exertion, and thereby upon a very great accumulation of heat and sweat.

This task is solved, in accordance with the inventions, by means of an article of clothing with the characteristics of described herein.

An article of clothing, particularly for wearing directly on the skin, which makes a sufficient removal of sweat possible, even upon very great physical exertions, is provided by means of the invention. The accumulation of sweat and its removal for the improvement of the body climate is provided by means of small tubes. Sweat, in the form of water vapor or drops of fluid, can enter into a small tube through the openings, and is thereby diverted from areas of the fabric close to the body to the outside.

"Fabric" in the sense of the present invention denotes a layer in an article of clothing, even if this layer is not produced by a weaving process and is not, consequently, a textile fabric in the conventional sense of the term. Textile layers that contain a weatherproofing membrane or have the form of a laminate connected with such layers, which likewise comprise an exposed weatherproofing membrane not covered by additional textile fabric layers, are thus included.

The openings, in particular, are advantageously positioned on the side oriented towards the weatherproofing membrane side and thereby, in particular, positioned on the side of the small tubes so that it is, in the condition of use, oriented upwardly—that is to say, on the side turned away from the ground. This configuration makes a simple entrance of the sweat possible as it flows down the fabric, and collects the sweat and serves as a channel in order to lead it away from the body of the wearer.

Additional openings can, however, also be provided on the side that is oriented directly towards the skin of the wearer, in order to make it easier to block the entrance of water vapor.

In a further development of the invention, the small tubes have a round cross-section. The production of the small tubes with round cross-section is particularly simple and, therefore, inexpensive.

In another further development of the invention, the small tubes have a triangular cross-section. This form of the small tubes offers the possibility of attaching the small tubes to the fabric on one of their sides, so that the small tubes are only placed on the skin at their tip. On the one hand, the wearing comfort is thereby increased and, on the other hand, a large support surface of the small tubes on the skin prevents the heat from being able to act in an insulating manner and an additional condensation surface for sweat from being formed.

The small tubes preferably protrude outside the article of clothing. This offers the possibility of allowing the sweat collected in the small tubes to exit from the article of clothing and to drip off outside the fabric.

The small tubes can be embedded in a fabric located underneath the weatherproofing membrane in the water-tight and wind-tight fabric. The absorption of sweat is, first of all, thereby carried out on the skin through the additional fabric. After that, the sweat is diverted through the openings and into the small tubes, from which the above-described operation continues.

Several individual small tubes can be provided in a formation at a distance from one another. The individual small tubes should be configured linearly, at least in the course from the highest point to the open ends, so that the moisture can thereby flow off unimpeded.

It is also possible, however, for several small tubes to be positioned in parallel and to be connected into a meandering loop in the form of arcs. In particular, a meandering course of the small tubes can be provided, in the course of which curves, and thereby vertical areas, are configured on the sides of the article of clothing, such as in the area of the chest or the back of a shirt, for example.

Figure 2:
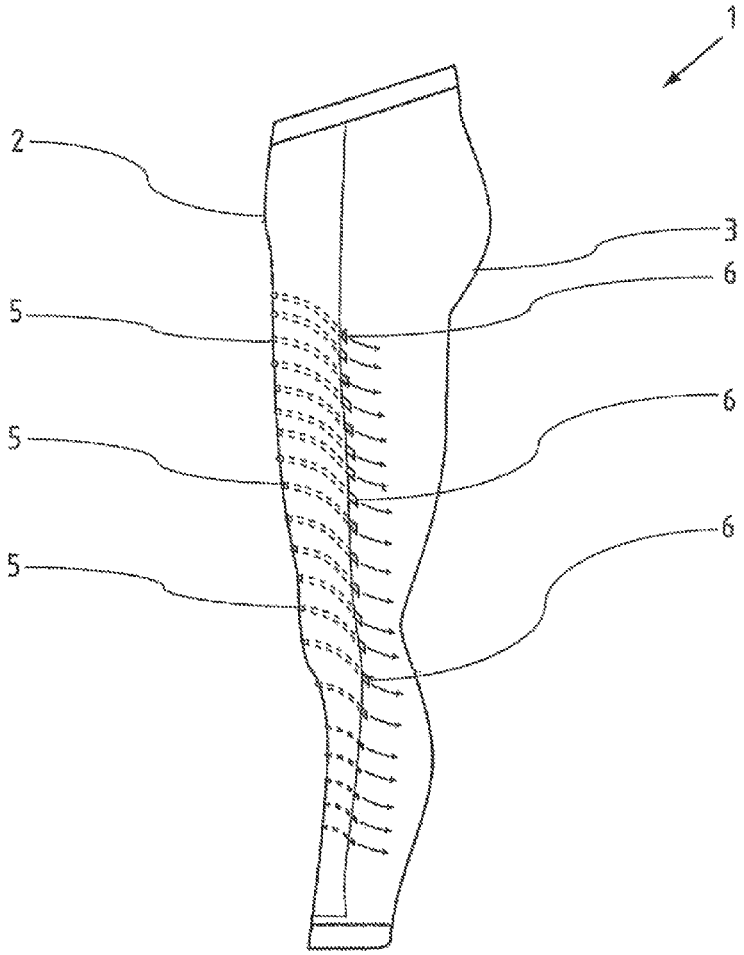
Figure 3:
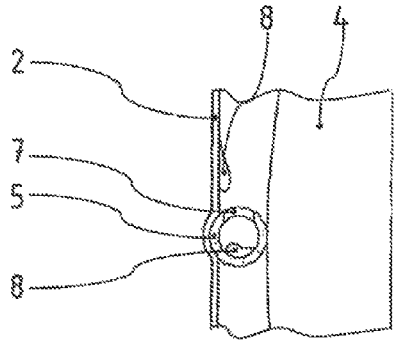
Figure 4:
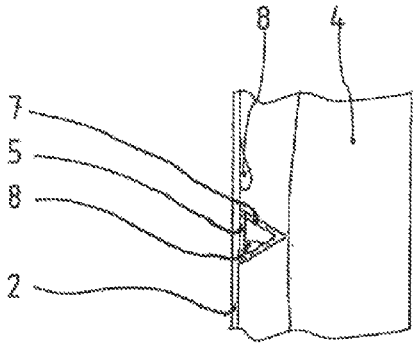
Figure 5:
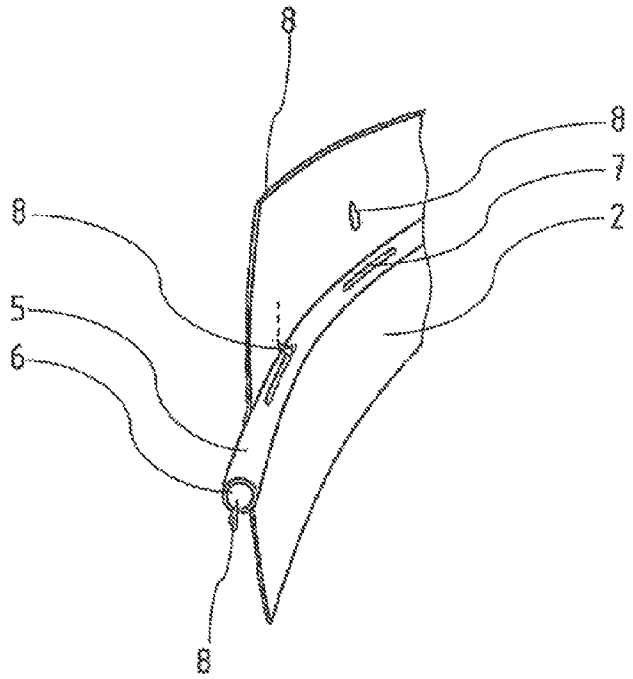
Figure 6:
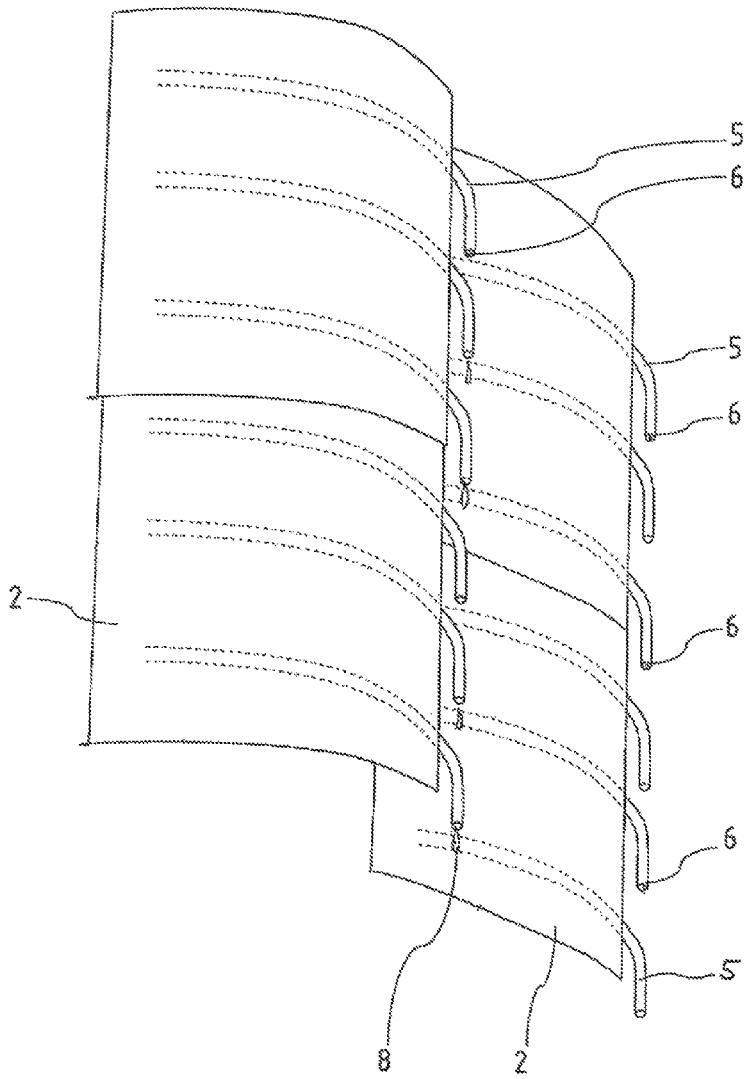

Other further developments and configurations of the invention are given in the remaining sub-claims. One embodiment of the invention is depicted in the diagrams and is described in individual terms in the following. The figures depict the following:

FIG. 1. A view of an article of clothing in the form of a pair of pants;

FIG. 2. The side view of the article of clothing depicted in FIG. 1;

FIG. 3. A sectionally enlarged depiction of a cross-section through the article of clothing depicted in FIG. 2;

FIG. 4. A sectionally enlarged depiction of a cross-section through an article of clothing in another configuration;

FIG. 5. An enlarged perspective depiction in sections of the article of clothing depicted in FIG. 3; and:

FIG. 6. An enlarged sectional view of an article of clothing in an additional configuration.

One article of clothing 1 selected as an embodiment involves, by way of example, a pair of pants. It consists on its front side of a water-tight and wind-tight fabric 2.

The rear side of the article of clothing 1 is formed by a conventional fabric 3, particularly an elastic fabric. On the side oriented towards the skin 4, small tubes 5 are provided on the water-tight and wind-tight fabric 2, which small tubes, in the worn state of the article of clothing 1, enter into contact with the skin (FIGS. 3 and 4).

The small tubes 5 can be produced from various materials. Small tubes of silicone, polytetrafluoroethylene (PTFE), or polyethylene have thereby particularly proven their value. In order to not impede the mobility of the wearer of the article of clothing, the small tubes 5 are flexible. In the embodiment, they are glued to the fabric 2. Other types of connection between the fabric 2 and the small tubes 5 are likewise possible, however.

Inside the article of clothing 1, the small tubes 5 proceed essentially horizontally. As can be seen in FIGS. 1 and 2, the small tubes 5 proceed around the front side of the legs of the pants.

The small tubes 5 are designed in an open manner on both of their ends 6. In the embodiment in accordance with FIGS. 1 and 2, the ends 6 are oriented essentially horizontally; in the embodiment in accordance with FIG. 6, the ends 6 are oriented vertically in the direction of the ground—that is to say, downwardly. The ends 6 of the small tubes 5 are located outside the article of clothing 1. As can be seen particularly clearly in FIG. 1, the small tubes 5 emerge from the article of clothing in the area of the transition between the water-tight and wind-tight fabric 2 and the elastic fabric 3.

In the embodiment, the small tubes 5 have a round cross-section (FIG. 3) or a triangular cross-section (FIG. 4). Other cross-sections, particularly oval or even multi-sided cross-sections, are likewise possible. The small tubes 5 are provided with openings 7.

The openings 7 are positioned on the side of the small tubes 5 oriented away from the ground (FIGS. 3 to 5). As is evident in FIG. 5, the openings 7 in the embodiment preferably have the form of an oblong hole and extend essentially in the longitudinal direction of the axial course of the small tubes.

When wearing the article of clothing in accordance with the invention, sweat condenses under the weatherproofing membrane in the fabric 2 since, during physical activities that are unusually strenuous, such as during running or bicycling, for example, the moisture produced by the body can no longer completely escape through the pores of the weatherproofing membrane. The sweat given off by the wearer precipitates on the internal side of the fabric 2, among other points (FIGS. 3 to 5). It runs off in the form of drops of sweat 8, following gravity downwardly, until it encounters the nearest small tube 5, which is oriented essentially horizontally.

There, the drops of sweat 8 enter into the small tubes 5 through the openings 7, as depicted in FIG. 5. The drops of sweat 8 collect on the base of the specific small tube 5, as depicted in FIGS. 3 and 4.

The more sweat enters into the small tubes 5, the more the drops of sweat 8 are distributed along the specific small tube 5. In addition, the sweat condenses out of the moist air inside the small tubes 5 in the form of water vapor. If the drops of sweat 8 reach the area of the ends 6, and if these are oriented vertically in the direction of the ground—that is to say, downwardly—, then the sweat 8, following gravity, likewise drips downwardly to the small tubes 5 (FIG. 6).

If the ends 6 are oriented essentially horizontally, then the drops of sweat 8, upon reaching the ends 6, likewise flow out of the small tubes 5. This condition, however, is amplified by the following fact: as can be seen in FIG. 2, the ends 6 of the small tubes 5 are oriented essentially horizontally and are, at the same time, directed downwardly. This orientation opposite to the direction of running or travelling is selected. This has the result that the air moves past the ends 6 of the small tubes 5 during running or bicycling. By this means, a low pressure, which leads to a suctioning of the drops of sweat 8 out from the small tubes 5, arises in the area of the ends 6 of the small tubes 5, as indicated by the arrows in FIGS. 1 and 2. This leads to a clearly improved removal of sweat from the article of clothing.

The removal of the sweat is additionally supported during physical exertion by the fact that a change in the air pressure takes place continuously underneath the article of clothing through the movement of the muscles as well as the movement of the fabric. This change supports the surge-like entrance of moist air into the openings 7 in a manner corresponding to the movement of the wearer, through which the carrying of sweat away from the article of clothing is further improved.

The invention claimed is:

1. An article of clothing to be worn directly on the skin of a wearer of the article of clothing, wherein a portion of the article of clothing is composed of a weatherproof fabric, such portion comprising:

small tubes, each tube having a first open end and a second open end between a peripheral surface, wherein the first open end and the second open end of the small tubes extend out of the article of clothing, wherein the peripheral surface further comprises openings, wherein the small tubes are located on the side of the weatherproof fabric oriented towards the skin of the wearer of the article of clothing; and wherein the small tubes through the openings collect sweat of the wearer and serve as channels to lead the sweat away from the body of the wearer.

2. The article of clothing in accordance with claim 1, wherein the small tubes are composed of silicone.

3. The article of clothing in accordance with claim 1, wherein the small tubes are composed of polytetrafluoroethylene (PTFE).

4. The article of clothing in accordance with claim 1 wherein the small tubes are composed of polyethylene.

5. The article of clothing in accordance with claim 1 wherein the openings are in the form of an oblong hole that extends along the small tubes.

6. The article of clothing in accordance with claim 1 wherein the small tubes have a round or oval cross-section.

7. The article of clothing in accordance with claim 1 wherein the small tubes have a triangular cross-section.

8. The article of clothing in accordance with claim 1 wherein the openings in the small tubes (5) are positioned substantially parallel to a head of the wearer.

9. The article of clothing in accordance with claim 1, wherein at least the first open end or the second open end is positioned towards the feet of the wearer.

10. The article of clothing in accordance with claim 1, wherein the weatherproof fabric is composed of water-tight fabric.

11. The article of clothing in accordance with claim 1, wherein the weatherproof fabric is composed of a wind tight fabric.

12. The article of clothing in accordance with claim 1, wherein the first open end and the second open end of the small tubes extend out of the article of clothing.

13. An article of clothing to be worn directly on the skin of a wearer of the article of clothing, wherein a portion of the article of clothing is composed of a weatherproof fabric, such portion comprising:

small tubes having two open ends between a peripheral surface, wherein the peripheral surface includes openings, wherein the small tubes are located on the side of the weatherproof fabric oriented towards the skin of the wearer of the article of clothing; and the two open ends of the small tubes protrudes outside the article of clothing, wherein, in use, moisture created by the wearer during physical exertion is removed from the body of the wearer through the openings of the small tubes to enhance the comfort of the wearer.

14. The article of clothing in accordance with claim 13, wherein the small tubes are constructed and arranged so as to carry moisture adjacent to the wearer to the exterior of the article of clothing.

15. The article of clothing in accordance with claim 13, wherein the small tubes are oriented essentially horizontally in use and the open ends thereof of the small tubes open in a direction opposite to the direction of motion of the wearer, whereby in use, air moves past the ends (6) of the small tubes (5), creating a low pressure that leads to suctioning of the moisture out from the small tubes (5), resulting in enhanced removal of moisture from the article of clothing.

16. An article of clothing to be worn directly on the skin of a user comprising:

an elastic fabric connected to a weatherproof fabric having an outside surface and a skin-facing surface and a membrane adjacent to the skin-facing surface of the weatherproof fabric;

the membrane comprising small tubes having a first open end and a second open end between a peripheral surface, wherein the peripheral surface further comprises openings oriented towards a head of the user;

wherein the first open end and the second open end extend from the article of clothing between the elastic fabric and the weatherproof fabric; and wherein the small tubes through the openings collect sweat of the wearer and serve as channels to lead the sweat away from the body of the wearer.

17. The article of clothing of claim 16 wherein the first open end and the second open of the small tubes extend in a direction opposite to a direction of motion of the user.

18. The article of clothing of claim 16 wherein the first open end and the second open end extend from the article of clothing.

* * * * *